US010144619B2

(12) United States Patent
LaValley

(10) Patent No.: US 10,144,619 B2
(45) Date of Patent: Dec. 4, 2018

(54) ATTACHMENT WITH VACUUM AND GRAB ARMS

(71) Applicant: LAVALLEY INDUSTRIES, LLC., Bemidji, MN (US)

(72) Inventor: Jason LaValley, Bemidji, MN (US)

(73) Assignee: LAVALLEY INDUSTRIES, LLC., Bemidji, MN (US)

( * ) Notice: Subject to any disclaimer, the term of this patent is extended or adjusted under 35 U.S.C. 154(b) by 218 days.

(21) Appl. No.: 14/938,393

(22) Filed: Nov. 11, 2015

(65) Prior Publication Data

US 2016/0137463 A1 May 19, 2016

Related U.S. Application Data

(60) Provisional application No. 62/079,272, filed on Nov. 13, 2014.

(51) Int. Cl.

| | |
|---|---|
| ***B66C 1/02*** | (2006.01) |
| ***B66C 1/44*** | (2006.01) |
| ***B66C 1/42*** | (2006.01) |

(52) U.S. Cl.

CPC ..... *B66C 1/44* (2013.01); *B66C 1/02* (2013.01); *B66C 1/0287* (2013.01); *B66C 1/427* (2013.01); *B66C 1/447* (2013.01)

(58) Field of Classification Search

CPC ..... B66C 1/44; B66C 1/02; B66C 1/0287; B66C 1/447; B66C 1/42; B63B 23/08;

(Continued)

(56) References Cited

U.S. PATENT DOCUMENTS 4,044,894 A * 8/1977 McDonald ..... B66C 1/06 294/65.5
5,330,242 A * 7/1994 Lucky, Sr. ..... B66C 3/16 294/106

(Continued)

FOREIGN PATENT DOCUMENTS

| | | | |
|---|---|---|---|
| EP | 1679462 | 7/2006 | |
| WO | WO 2012/112863 | * 8/2012 | ..... B66C 3/16 |
| WO | 2013166559 | 11/2013 | |

OTHER PUBLICATIONS

International Search Report and Written Opinion, issued in the corresponding International application No. PCT/US2015/060130, dated Feb. 16, 2016, 12 pages.

*Primary Examiner* — Lynn E Schwenning
(74) *Attorney, Agent, or Firm* — Hamre, Schumann, Mueller & Larson, P.C.

(57) ABSTRACT

An attachment that incorporates a vacuum mechanism along with one or more grab arm assemblies. The vacuum mechanism and each grab arm assembly are configured to hold an object at the same time. In other embodiments, the object can be held solely by the vacuum mechanism or solely by the grab arms. In case of failure of the vacuum mechanism, for example a loss of suction or vacuum power or the vacuum is not properly centered on the object, the grab arm assembly acts as a back-up lifting mechanism to hold the object so that the object is not dropped. In addition, the grab arm assembly permits the attachment to hold the object in orientations, such as vertical, that are not possible using the vacuum mechanism by itself.

10 Claims, 10 Drawing Sheets

(58) Field of Classification Search
CPC ..... B63B 27/34; E21B 19/15; E21B 19/155; E21B 19/14; E21B 19/20; B26D 7/02
USPC ..... 414/800, 910, 911
See application file for complete search history.

(56) References Cited

U.S. PATENT DOCUMENTS

| | | | | |
|---|---|---|---|---|
| 5,411,304 | A * | 5/1995 | Muto | B66C 1/06 294/106 |
| 6,860,531 | B2 | 3/2005 | Sherwin | |
| 6,926,488 | B1 * | 8/2005 | Bolding | E21B 19/15 211/70.4 |
| 7,044,706 | B2 * | 5/2006 | Jung | B25J 15/0052 294/119.1 |
| 8,146,971 | B2 | 4/2012 | LaValley et al. | |
| 8,328,071 | B2 * | 12/2012 | LaValley | B26D 3/16 228/212 |
| 8,348,319 | B2 | 1/2013 | LaValley et al. | |
| 8,490,519 | B2 | 7/2013 | LaValley et al. | |
| 8,567,836 | B2 | 10/2013 | LaValley et al. | |
| 9,446,933 | B1 * | 9/2016 | Solomon | E01F 15/006 |
| 2002/0079137 | A1 * | 6/2002 | Mills | E21B 19/14 175/52 |
| 2013/0309044 | A1 * | 11/2013 | Adams | E21B 19/14 414/22.51 |
| 2014/0028038 | A1 | 1/2014 | LaValley et al. | |
| 2014/0054911 | A1 | 2/2014 | Solomon | |

* cited by examiner

ATTACHMENT WITH VACUUM AND GRAB ARMS

FIELD

This disclosure relates to an attachment for grasping and manipulating objects, for example cylindrical elongated objects such as pipes, tubes, etc. or non-cylindrical and/or non-elongated objects such as road barriers, I-beams, rectangular or square tubing, etc. The attachment is attachable to, for example, a trackhoe, backhoe, excavator or other piece of construction equipment.

BACKGROUND

Vacuum lifts that are attachable to excavators and the like are known in the art for lifting objects such as sections of pipe, road barriers and other objects. In the case of pipe lifting, a vacuum lift needs to be generally centered on the pipe to avoid tilting of the pipe during lifting. If the vacuum lift is not centered properly on the pipe, an off center lift occurs creating a tipping movement. This tipping movement can break the vacuum seal between the vacuum lift and the pipe or result in dangerous tilting and loss of control of the pipe. In addition, when lifting objects in general, loss of suction or vacuum power can result in release of the object being lifted from the vacuum lift resulting in dangerous conditions. In addition, in order to obtain an effective seal of the vacuum lift, the surface of the object being lifted must be clean without the presence of any dirt, snow or ice as well as being relatively smooth.

U.S. 2014/0054911 discloses a vacuum lift mechanism for lifting road barriers.

U.S. Pat. Nos. 8,146,971, 8,328,071, 8,348,319, 8,490,519, and 8,567,836 describe pipe handling attachments that are attachable to excavators and that can lift and manipulate section of pipe using grab arms.

SUMMARY

An attachment is described that incorporates a vacuum mechanism along with one or more grab arm assemblies for grasping, manipulating, lifting and moving objects. The vacuum mechanism and each grab arm assembly are configured to hold the object at the same time. In case of failure of the vacuum mechanism, for example a loss of suction or vacuum power or the vacuum is not properly centered on the object being lifted, the grab arm assembly acts as a back-up lifting mechanism to hold the object so that the object is not dropped. In addition, the grab arm assembly permits the attachment to hold the objects in orientations, such as vertical, that may not be possible using the vacuum mechanism by itself.

The attachment can be used to lift many objects. For example, in one embodiment, the attachment can be configured for lifting cylindrical elongated objects such as pipes, tubes, etc. In another embodiment, the attachment can be configured for lifting non-cylindrical and/or non-cylindrical objects such as road barriers, road mats, slabs of concrete, steel plates, and the like, I-beams, rectangular or square tubing, etc. The attachment can be configured to lift any object as long as the vacuum mechanism can apply its vacuum to the object and the grab arm assembly can grip the object.

In an embodiment, the attachment is mounted on construction equipment, for example mounted to the arm or "stick" of construction equipment such as an excavator, track hoe, back hoe, or similar prime mover or heavy construction equipment. The operations of the attachment and the construction equipment can be controlled from the operator's cab of the construction equipment or remotely controlled (for example, via radio signals or physically tethered) from a portable control assembly that can be manually carried by a user or is otherwise located outside of the operator's cab of the construction equipment.

In one embodiment, an attachment that is attachable to construction equipment includes a vacuum mechanism configured for picking up an object via vacuum, and at least one grab arm assembly. The grab arm assembly includes grab arms that are moveable between a retracted position and a gripping position for gripping an object held by the vacuum mechanism.

In one embodiment of use, the vacuum mechanism can be used to initially pick up an object using its vacuum power. To permit the vacuum mechanism to engage the object, the grab arms of the grab arm assembly are moveable in any suitable manner to a retracted position to move the grab arms out of the way to permit engagement by the vacuum mechanism. Any means for moving the grab arms to the retracted position can be used. For example, the grab arms can be moved, or the grab arm assembly as a whole along with the grab arms connected thereto can be moved thereby moving the grab arms out of the way. Once the vacuum mechanism has picked up the object, the grab arms can then be moved to the gripping position to grip the object together with the holding force provided by the vacuum mechanism.

In another embodiment, the grab arms remain in the retracted position while the vacuum mechanism is lifting the object. In case of an actual or perceived failure of the vacuum mechanism that could result in the object being dropped, the grab arms can be moved to the gripping position to grip the object and prevent the object from falling so that the lifting and moving of the object can continue.

The attachment can be provided with rotation about a vertical axis, pivoting or tilting about an axis perpendicular to the vertical axis and/or movement of the grab arm assembly, together with any movements provided by the construction equipment. Movements of this type are described in U.S. Pat. Nos. 8,146,971, 8,328,071, 8,348,319, 8,490,519, and 8,567,836 each of which is incorporated herein by reference in its entirety.

DRAWINGS

Figure 9:
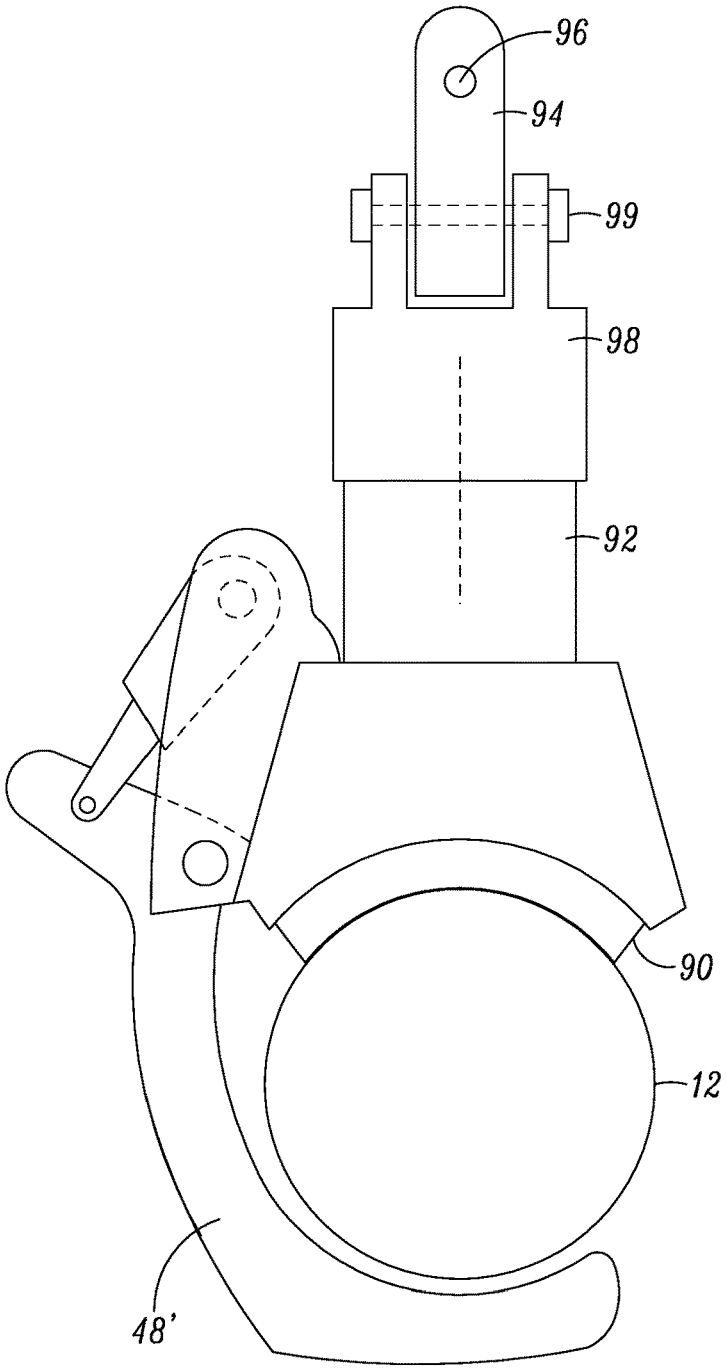

FIG. 9 in an end view of another embodiment of a grab arm assembly of an attachment using a single grab arm for gripping a pipe being lifted.

Figure 10:
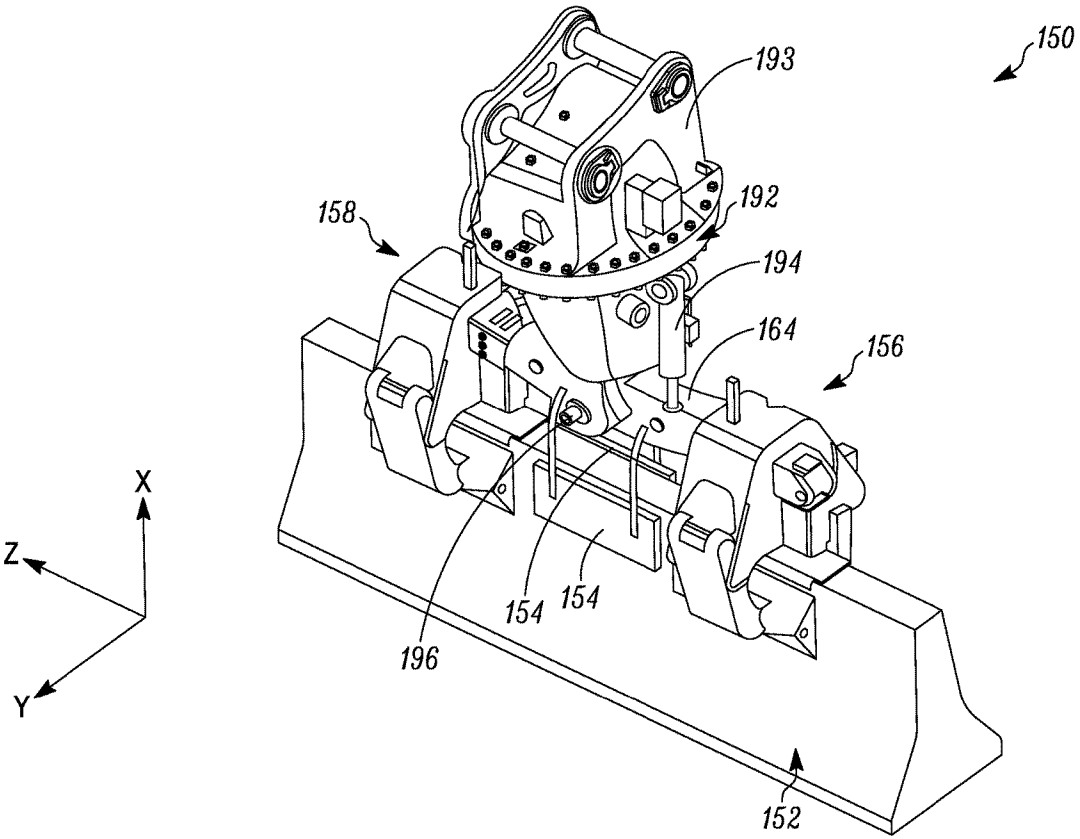

FIG. 10 is a perspective view of an attachment described herein that is configured for handling a road barrier.

Figure 11:
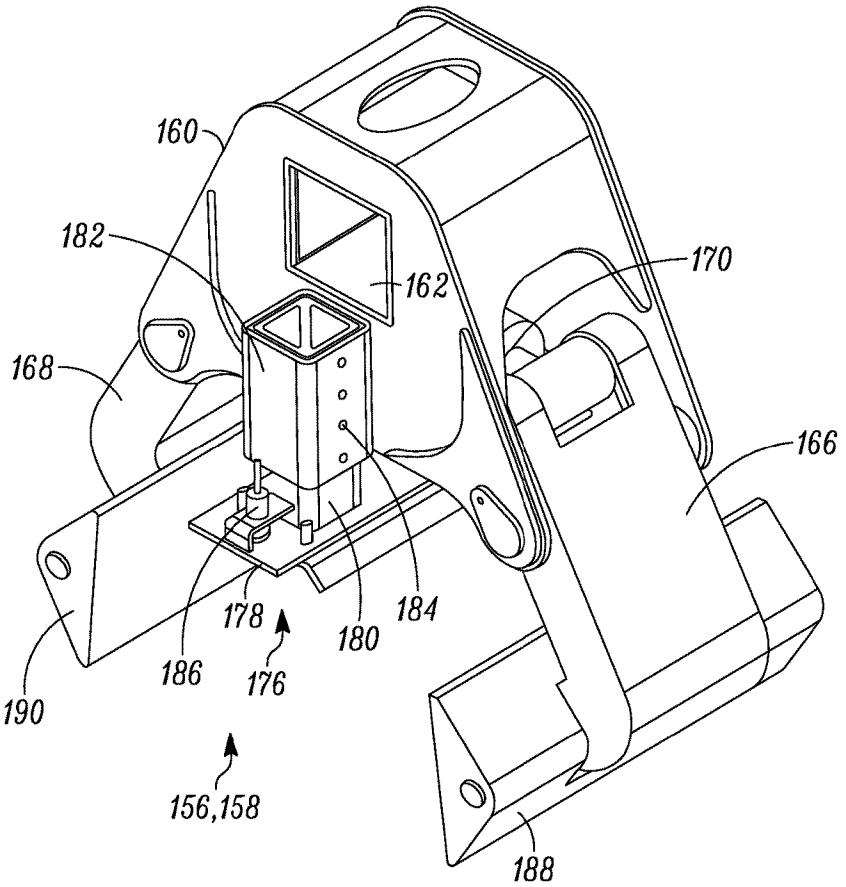

FIG. 11 is a perspective view of one of the grab arm assemblies used in the attachment in FIG. 10.

Figure 12:
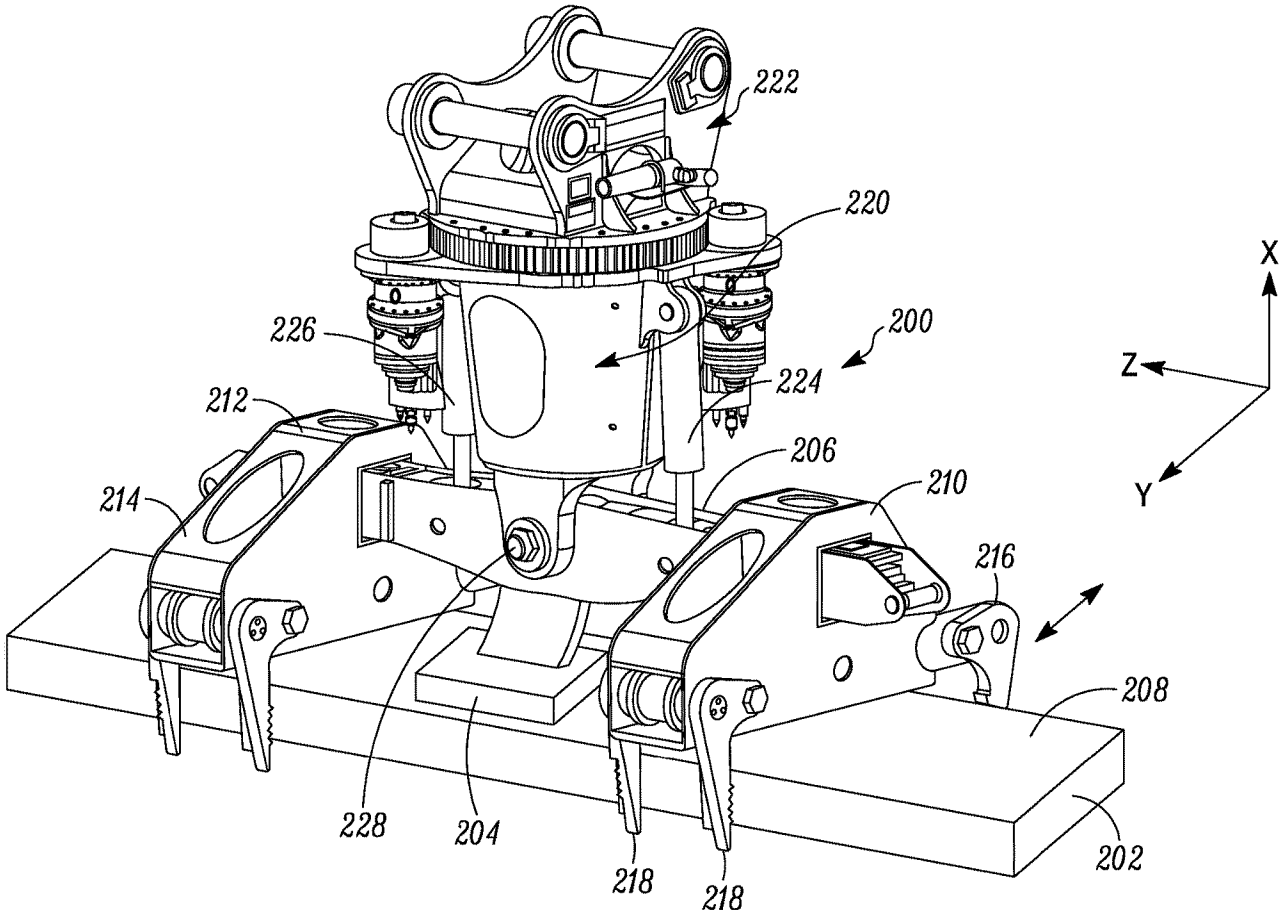

FIG. 12 is a perspective view of an attachment described herein that is configured for handling an object in the form of a slab or plate of material.

DETAILED DESCRIPTION

An attachment is described that incorporates a vacuum mechanism along with one or more grab arm assemblies. The vacuum mechanism and each grab arm assembly are configured to hold the object at the same time. In case of failure of the vacuum mechanism, for example a loss of suction or vacuum power or the vacuum is not properly centered on the object, the grab arm assembly can act as a back-up lifting mechanism to hold the object so that the object is not dropped. In addition, the grab arm assembly permits the attachment to hold the object in orientations, such as vertical, that are not possible using the vacuum mechanism by itself.

In one embodiment, the attachment can be configured for lifting cylindrical elongated objects such as pipes, tubes, etc. In another embodiment, the attachment can be configured for lifting non-cylindrical and/or non-cylindrical objects such as road barriers, road mats, slabs of concrete, steel plates and the like, I-beams, rectangular or square tubing, etc. The attachment can be configured to lift any object as long as the vacuum mechanism can apply its vacuum to the object and the grab arm assembly can grip the object.

For sake of convenience, an attachment described herein that is configured for lifting and handling pipe may be referred to herein as a pipe handling attachment.

For sake of convenience, an attachment described herein that is configured for lifting and handling road barriers may be referred to herein as a road barrier handling attachment.

For sake of convenience, an attachment described herein that is configured for lifting and handling slabs such as concrete slabs, steel plates, and the like may be referred to herein as a slab handling attachment.

In some embodiments, the attachments described herein attach to a single arm of the construction equipment or prime mover, such as an excavator, track hoe, back hoe, or similar prime mover or heavy construction equipment.

In some embodiments, an attachment is defined herein as a tool that is removably mounted to the end of an arm of the construction equipment or prime mover, and when mounted modifies the construction equipment or prime mover to perform a completely new scope of work compared to a different type of attachment that can also be mounted to the end of the arm. The attachment can be removed from the arm of one piece of construction equipment or prime mover, and mounted to the arm of a different construction equipment or prime mover.

Pipe Handling Attachment

Figure 1:
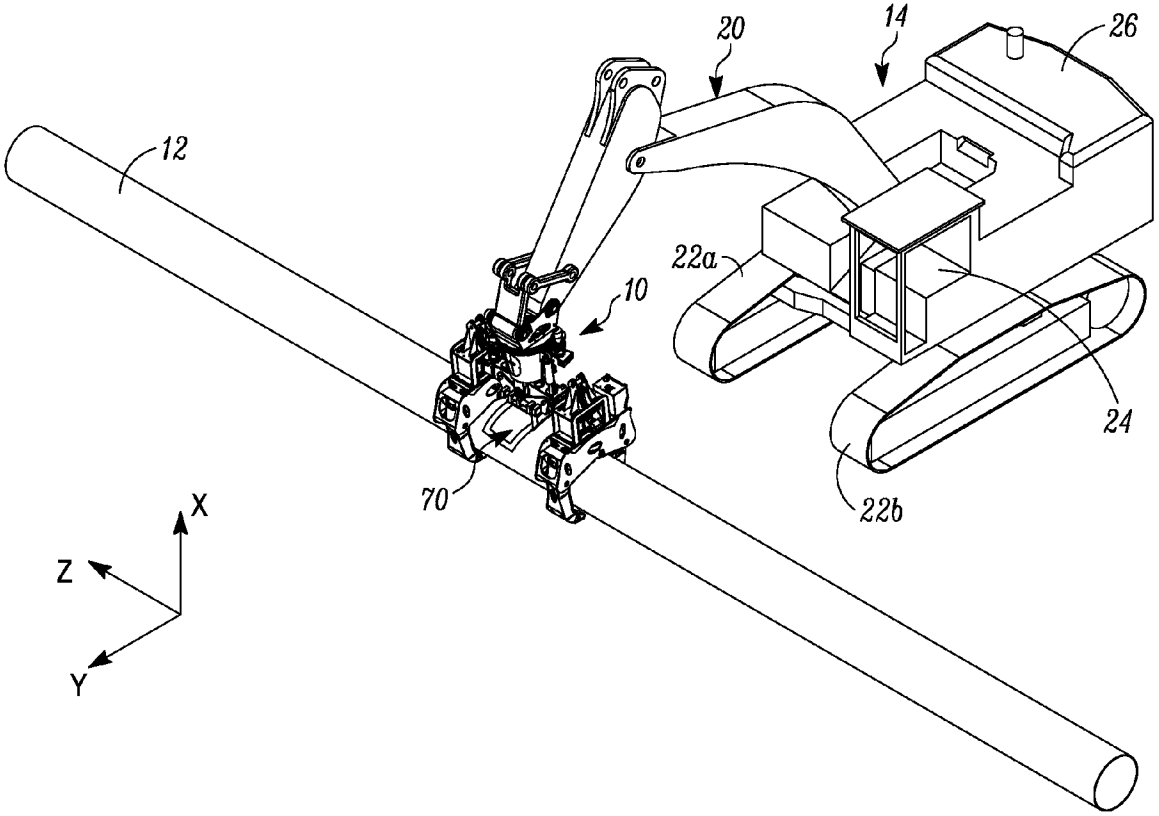
FIG. 1 is a perspective view of an attachment described herein attached to an arm of an excavator, where the attachment is configured for handling pipe.
Figure 2:
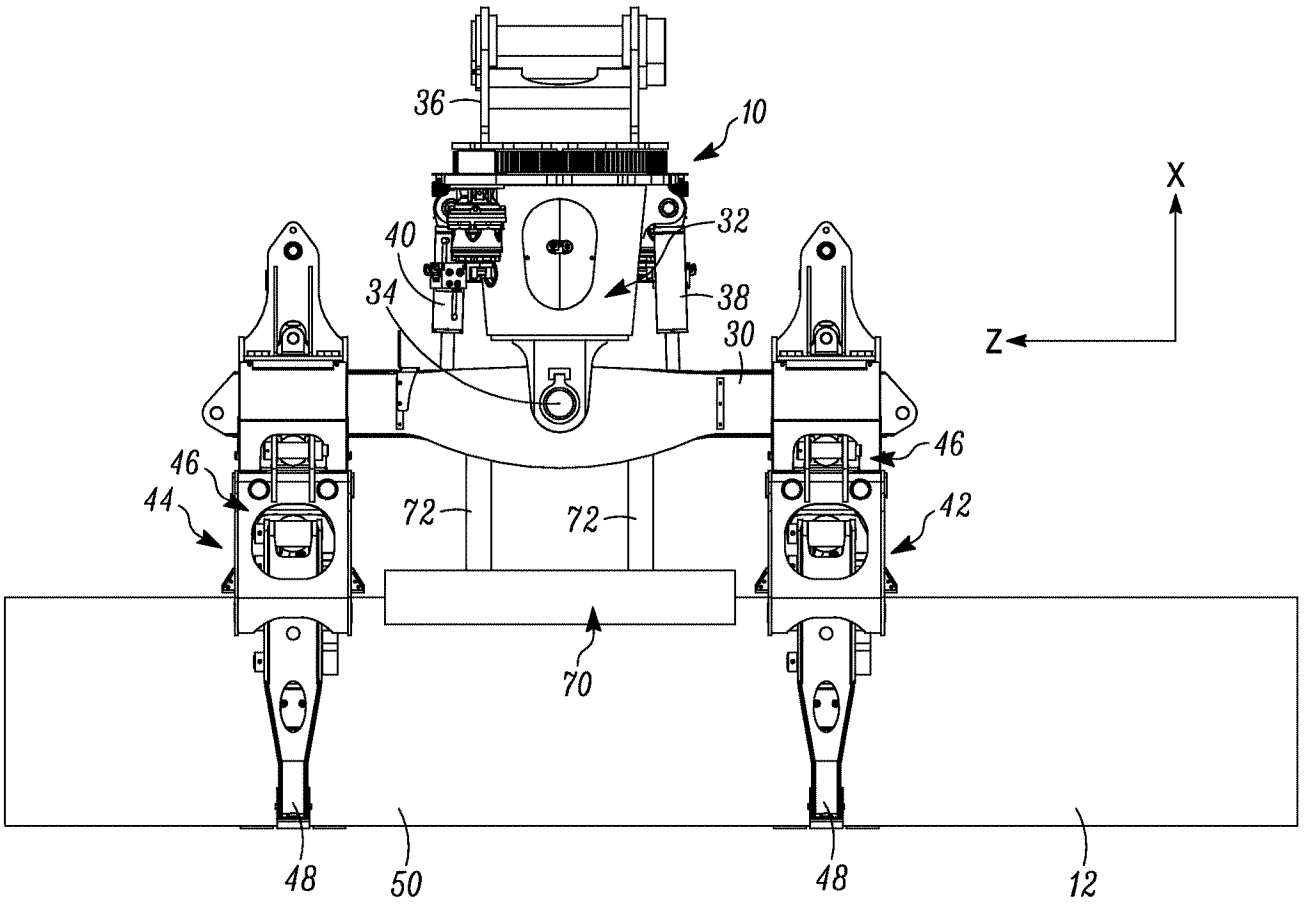
FIG. 2 is a side view of the attachment of FIG. 1 shown gripping a pipe.

FIGS. 1-2 illustrate an attachment 10 that is configured for handling a length or section of pipe 12. As used herein, the term "handling" pipe includes but is not limited to picking up the pipe 12 from a stack of pipes (such as on a trailer) or from any other location (such as from the ground or a single pipe located on a trailer) and delivering the pipe 12 to a location where the pipe 12 is intended to be used, placing the pipe 12 onto a stack of pipes (such as on a trailer) or onto any other location (such as onto the ground or as a single pipe onto a trailer) where the pipe 12 is to be stored (temporarily or permanently) or for transport to another location, or for holding and/or positioning the pipe 12 during some operation to be performed on the pipe 12 or that involves the pipe 12. The attachment 10 illustrated in FIGS. 1-2 can pick up a pipe from, or place a pipe onto, the center of a pipe stack where the pipe to be picked up from the stack or placed onto the stack is surrounded by one or more pipes on at least one side as discussed below with respect to FIG. 3.

For example, the attachment 10 can be used to handle pipe including pipe involved in directional drilling as described in U.S. Pat. Nos. 8,146,971 and 8,567,836 each of which is incorporated herein by reference in its entirety. In addition, the attachment 10 can be used to place one pipe next to another end-to-end and can aid in positioning the end of the two pipes relative to one another for welding the pipe ends together or for performing another processing operation on one or more of the pipe ends as described in U.S. Pat. No. 8,328,071 which is incorporated herein by reference in its entirety. In addition, the attachment 10 can be used to make-up or break-out two pipe ends as described in U.S. Pat. No. 8,490,519 which is incorporated herein by reference in its entirety.

The attachment 10 is configured to be attachable to construction equipment 14. The construction equipment 14 can be any type of construction equipment to which the attachment 10 can be mounted. The construction equipment 14 is illustrated in FIG. 1 as being an excavator that includes a hydraulically controllable arm 20, tracks 22*a*, 22*b*, an operator's cab 24 and an engine assembly 26. The excavator is of generally well known construction and as would be understood by a person of ordinary skill in the art, the tracks 22*a*, 22*b* are used to steer the excavator and move the excavator from position to position. In addition, the upper portion of the excavator including the cab 24 and the engine assembly 26 are rotatable about a vertical axis relative to the tracks 22*a*, 22*b*. However, the construction equipment is not limited to being an excavator and other types of construction equipment can be used.

The various movements of the construction equipment 14, including movements of the arm 20, rotation of the tracks 22*a*, 22*b*, and rotation of the cab 24, can be controlled in conventional manner, for example using hydraulics and hydraulic actuators.

The attachment 10 is mounted to the end of the arm 20 of the excavator. With reference to FIGS. 1-2, the attachment 10 includes a main beam 30 (also referred to as a support structure) that is pivotally connected to the base of a head assembly 32 by a pivot 34 for pivoting or tilting about a y-axis. The head assembly 32 is rotatably connected to a mount bracket (or upper head assembly) 36 to permit the head assembly 32 to rotate or swivel continuously relative to the mount bracket 36 about a vertical x-axis (i.e. continuous rotation about the vertical x-axis). The mount bracket 36 detachably and pivotally mounts the attachment 10 to the arm 20 of the construction equipment. One or more tilt actuators 38, 40 extend between the head assembly 32 and the main beam 30 to selectively tilt the main beam 30 about the pivot 34 (i.e. about the y-axis). Further information on the construction and operation of a main beam, head assembly, mount bracket and tilt actuators can be found in U.S. Pat. Nos. 8,146,971 and 8,567,836.

In the embodiment illustrated in FIGS. 1 and 2, the attachment 10 includes a pair of grab arm assemblies 42, 44 mounted on the main beam 30. However, in another embodiment, a single grab arm assembly can be used. In still another embodiment, more than two grab arm assemblies are provided.

With reference to FIG. 2, the grab arm assemblies 42, 44 can be mounted on the main beam 30 so that each grab arm assembly is individually adjustable relative to the main beam 30 along the length of the main beam in a z-axis direction. Adjustment of each grab arm assembly 42, 44 can be achieved by shift cylinders (not visible) which are disposed within the main beam 30, and each of which is fixed at one end to the main beam 30 and fixed at an opposite end to the grab arm assemblies 42, 44. If desired, the shift cylinders can be located outside of the main beam 30. Further information on shifting grab arm assemblies on a main beam in a z-axis direction is described in U.S. Pat. No. 8,567,836.

In addition, the grab arm assemblies 42, 44 can be shiftable forward and backward in the y-axis direction, and up and down in the x-axis direction, to shift the position of the pipe 12 in the y-axis and x-axis directions. Further information on shifting grab arm assemblies in y-axis and x-axis directions is disclosed in U.S. Patent Application Publication No. 2014/0028038 the entire contents of which are incorporated herein by reference.

The z-axis direction is considered generally parallel to the ground, or parallel to the main beam 30, or parallel to the pipe 12, or left and right when viewing FIG. 2. The x-axis direction is an up and down vertical direction generally perpendicular to the z-axis direction and perpendicular to the main beam 30 when viewing FIG. 2. The y-axis direction is a forward and rearward direction generally perpendicular to the z-axis direction and to the x-axis direction, and perpendicular to the main beam 30 when viewing FIG. 2, and into and out of the page when viewing FIG. 2.

The grab arm assemblies 42, 44 can be identical in construction, but can also be different in construction from each other. Each grab arm assembly can include a grab arm housing 46 and two or more grab arms 48 connected to the grab arm housing. Operation of the grab arms 48 is controlled using one or more actuators 68 (FIG. 3) which can be, but are not limited to, hydraulic cylinders, on the grab arm assemblies 42, 44. The grab arm housings 46 and the grab arms 48 can be similar in construction and operation to any of the grab arm housings and grab arms described in U.S. Pat. Nos. 8,146,971, 8,328,071, 8,348,319, 8,490,519, and 8,567,836 or in U.S. Patent Application Publication No. 2014/0028038.

As shown in FIGS. 1-2, a vacuum mechanism 70 is mounted to the main beam 30. The vacuum mechanism 70 can be any type of vacuum mechanism 70 that is well known in the art of pipe lifting. In general, the vacuum mechanism 70 is configured to apply a vacuum or suction force to the upper surface of the pipe 12 to permit the attachment 10 to pick up the pipe 12 using the vacuum force. The construction and operation of vacuum lift mechanisms is well known in the art. An example of a suitable form of vacuum lift mechanism is available from VACULIFT™ Inc. of Tulsa, Okla.

The vacuum mechanism 70 can be mounted to the main beam 30 in any suitable manner that supports the vacuum mechanism, permits application of the vacuum force to the pipe surface, and that permits lifting of the pipe under power of the construction equipment 14. For example, one or more supports 72 can extend between the main beam 30 and the vacuum mechanism 70 to fix the vacuum mechanism to the main beam. In some embodiments, a conduit for routing applied suction from a suction generation device to the vacuum mechanism 70 can extend through one or more of the supports 72.

Figure 5:
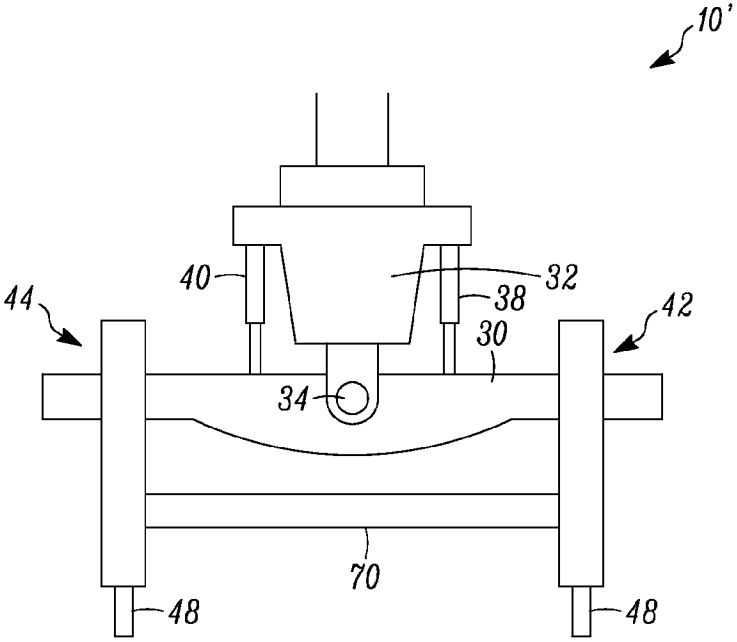
FIG. 5 is a side view of another embodiment of an attachment that is configured for lifting pipe with the vacuum mechanism mounted to the grab arm assemblies.

FIG. 5 illustrates an embodiment of the pipe handling attachment 10' that is similar to the attachment 10, but with the vacuum mechanism 70 mounted between and to the grab arm assemblies 42, 44 rather than being mounted directly to the main beam 30 by the supports 72. The vacuum mechanism 70 can be mounted to the grab arm assemblies 42, 44 to permit the grab arm assemblies 42, 44 to shift relative to the main beam 30 and optionally relative to the vacuum mechanism 70 in the x, y and z-axis directions as discussed above. The attachment 10' functions identically to the attachment 10 in that the vacuum mechanism 70 can be used to pick up a pipe, followed by closing of the grab arms 46, 48 to help hold the pipe.

Figure 6:
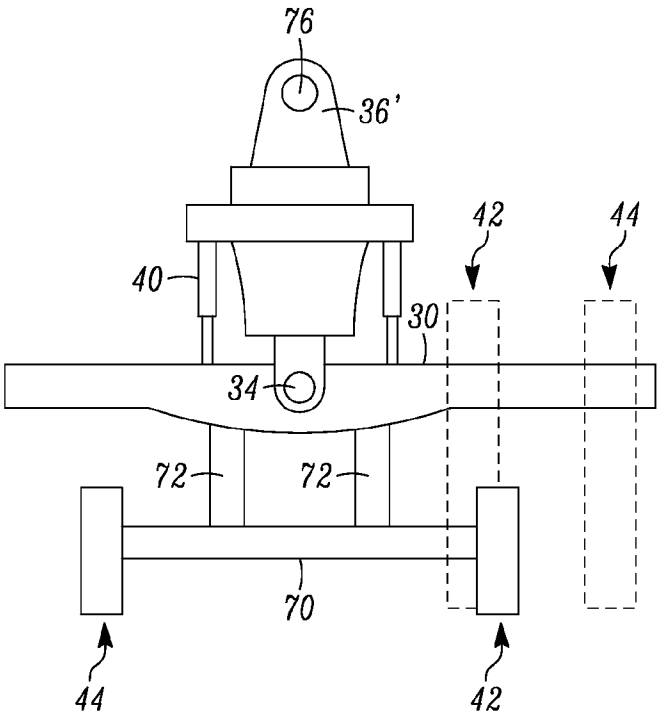
FIG. 6 is a side view of another embodiment of an attachment that is configured for lifting pipe with a single pivot mounting, and illustrating different options for mounting the grab arm assemblies.
Figure 7:
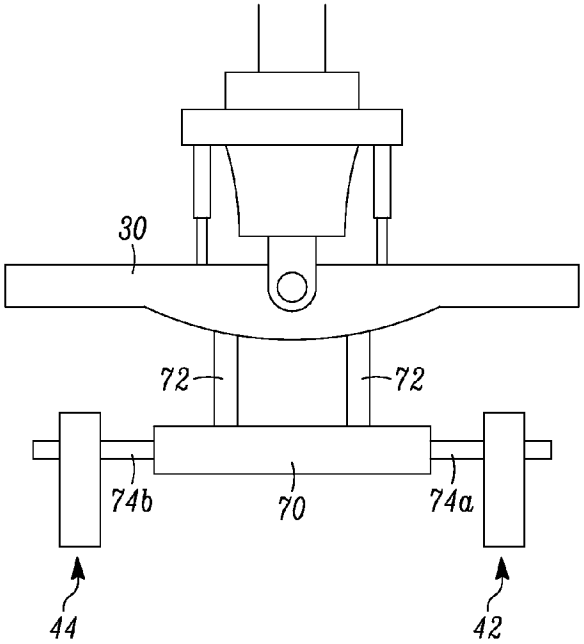
FIG. 7 is a side view of another embodiment of an attachment that is configured for lifting pipe with the grab arm assemblies mounted to the vacuum mechanism.

In the illustrated embodiment in FIGS. 1-2 and 5, the grab arm assemblies 42, 44 are disposed on opposite sides of the vacuum mechanism 70. However, in another embodiment illustrated in dashed lines in FIG. 6, the grab arm assemblies 42, 44 can be disposed on the same side of the vacuum mechanism 70. In addition, although the grab arm assemblies 42, 44 are shown as being mounted on the main beam 30, in other embodiments the grab arm assemblies 42, 44 can be mounted directly to the vacuum mechanism 70, or to one or more beam structures that extend from the vacuum mechanism 70. For example, FIG. 6 shows the grab arm assemblies 42, 44 mounted at or to opposite ends of the vacuum mechanism 70. In another embodiment, FIG. 7 shows the grab arm assemblies 42, 44 mounted to beam structures 74*a*, 74*b* that are fixed to and extend from the vacuum mechanism 70.

FIG. 6 also shows a variation where instead of using the mount bracket 36, a mount bracket 36' that provides a single pivot 76 attachment to the arm 20 of the construction equipment 14 is provided. The single pivot 76 permits the attachment to freely swing relative to the arm 20 of the construction equipment 14 about the axis of the pivot 76. FIG. 6 shows the axis of the pivot 76 as being substantially parallel to the axis of the pivot 34 or substantially parallel to the y-axis direction. However, the bracket 36' can be oriented such that the axis of the pivot 76 is substantially perpendicular to the axis of the pivot 34 or substantially perpendicular to the y-axis direction (substantially parallel to the z-axis direction). In other embodiments, the bracket 36' can be oriented such that the axis of the pivot 76 is arranged at any angle between the y-axis direction and the z-axis direction.

Other arrangements and locations of the grab arm assembly(ies) 42, 44 are possible. In general, the grab arm assembly(ies) 42, 44 and the vacuum mechanism 70 can be mounted on the attachment 10 relative to one another in any manner that permits the grab assembly(ies) 42, 44 and the vacuum mechanism 70 to function together in the manner described herein to lift and otherwise handle the pipe 12.

With the attachment 10, in one embodiment the vacuum mechanism 70 can be the primary or initial means for lifting the pipe 12. In such an embodiment, the attachment 10 is configured so that the vacuum mechanism 70 engages the pipe 12 and lifts the pipe 12 before the grab arm assemblies 42, 44 grip the pipe. To accomplish this, the grab arms 48 are moveable between a retracted position and a gripping position. The retracted position permits the attachment 10 to fit over the pipe 12 so that the vacuum mechanism 70 can engage the pipe 12 without interference from the grab arm assemblies 42, 44 or the grab arms 48. At the gripping position, the grab arms 48 can then be actuated to the gripping position to grip the pipe 12 that is already held by the vacuum mechanism 70.

In an embodiment, for example when picking up a single pipe that is not closely adjacent to other pipes, the retracted position of the grab arms 48 can be relatively minimal to permit the pipe 12 to fit between the grab arms 48 so that the vacuum mechanism 70 can engage the pipe, followed by moving the grab arms 48 to the gripping position shown in FIG. 1.

In an embodiment, for example when lifting up a pipe that is stacked with other pipes in a pipe stack where the grab arms 48 may bump into one or more pipes that are adjacent to the pipe to be lifted, the grab arms 48 may need to be moved to a more extreme retracted position to prevent interference between the grab arms 48 and the adjacent pipes to permit the vacuum mechanism 70 to engage the pipe to be lifted.

Figure 3:
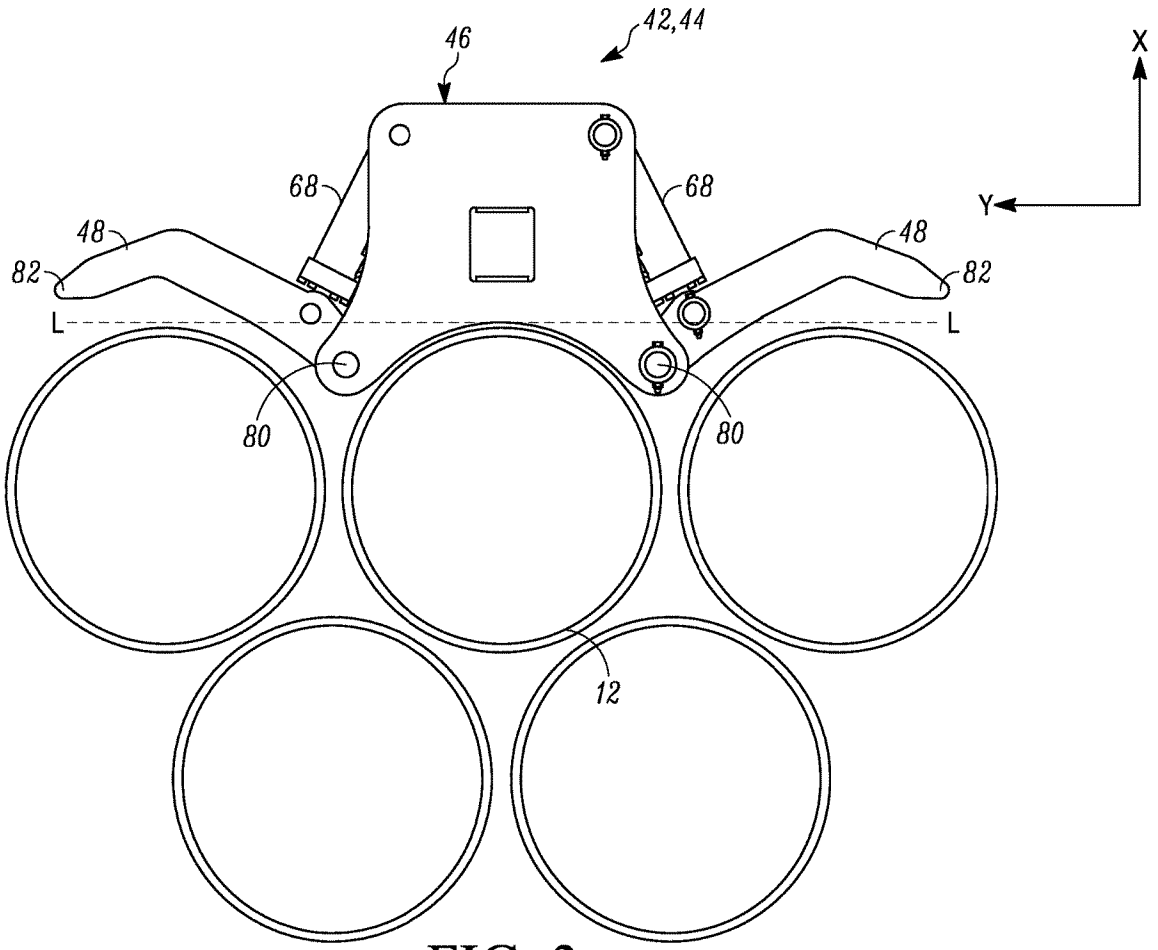
FIG. 3 is an end view of a grab arm assembly of the attachment of FIGS. 1 and 2 showing the grab arms at a retracted position to permit the vacuum mechanism to pick up a pipe from a stack of pipes or to place a pipe onto a stack of pipes.

An example of a more extreme retracted position is shown in FIG. 3. In this embodiment, the grab arms 48 are shown as being pivotally mounted at one end thereof to the grab arm housing 46 by pivots 80 for pivoting movement in the x-y plane, i.e. about pivot axes that are parallel to the z-direction, or parallel to the main beam 30. The opposite ends of the grab arms are tip ends 82. The actuators 68 are each connected at one end to the housing 46 and to the respective grab arm 48 between the pivots 80 and the tip end 82.

To reach the retracted position shown in FIG. 3, the grab arms 48 should pivot upward a large enough distance such that the tip ends 82 are disposed above a highest level L of the pipe 12 and any adjacent pipes. With this configuration, when the attachment 10 is brought down to initiate lifting of the pipe 12 by the vacuum mechanism 70, the grab arms 48 are clear of adjacent pipes next to the pipe 12. This permits the attachment 10 to be brought down so that the vacuum mechanism 70 can engage the top surface of the pipe 12 to be lifted to apply the vacuum force to the pipe. The pipe 12 is then lifted upward under the force of the construction equipment arm 20 using the vacuum mechanism 70. Once the pipe 12 is lifted and clear of adjacent pipes, the grab arms 48 can then be pivoted downward to the gripping position shown in FIGS. 1 and 2 to grip the pipe and thereby supplement the holding force of the vacuum mechanism 70.

Similarly, when lowering the pipe 12 to place it onto a pipe stack, the grab arms 48 can first be moved to the retracted position, then the pipe is placed onto the pipe stack, and the vacuum applied by the vacuum mechanism 70 is terminated to release the pipe.

The described attachment 10 can thus pick up a pipe from, or place a pipe onto, the center of a pipe stack where the pipe to be picked up from the stack or placed onto the stack is surrounded by one or more pipes on at least one side as illustrated in FIG. 3.

Although the grab arms 48 are described as pivoting about the pivots 80, any means for moving the grab arms 48 out of the way to allow the vacuum mechanism 70 to engage the pipe to be lifted can be used.

In one embodiment, the pipe 12 can be lifted and held solely by the vacuum mechanism 70 and the grab arms 48 are not used. In another embodiment, the pipe 12 can be lifted and held solely by the vacuum mechanism 70 and the grab arms 48 are used only in an emergency if an actual or perceived failure in the vacuum mechanism 70 arises. In another embodiment, the pipe 12 can be picked up and/or placed, as well as held, solely by the grab arms 48 and the vacuum mechanism 70 is not used. Therefore, when setting or placing pipe using just the vacuum mechanism 70 without using the grab arms, the grab arms do not need to be actuated to the retracted position because they would already be opened. However, when setting pipe using the vacuum mechanism together with the grab arms, the grab arms would need to be actuated to the retracted position from the gripping position.

Figure 8:
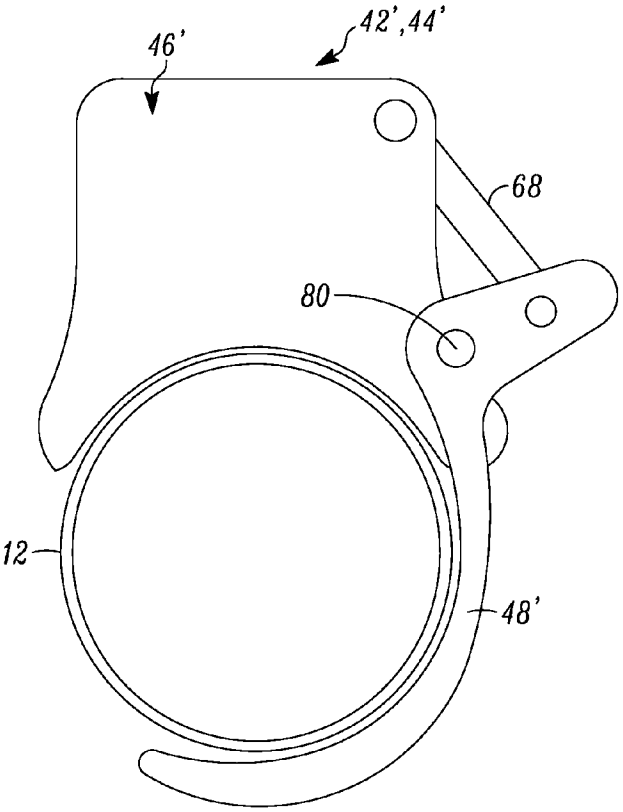
FIG. 8 is an end view of another embodiment of a grab arm assembly of an attachment using a single grab arm for gripping a pipe being lifted.

An alternative embodiment of a grab arm assembly 42', 44' is illustrated in FIG. 8 where instead of a pair of grab arms 48, the grab arm assembly 42', 44' uses a single grab arm 48' mounted to the grab arm housing 46'. In this embodiment, the grab arm 48' is pivotally mounted via the pivot 80 and can pivot between the gripping position shown in FIG. 8 and the extreme retracted position (not shown) similar to the grab arms 48 such that the tip end of the grab arm 48' is disposed above a highest level L of the pipe 12 and any adjacent pipes. Movement of the grab arm 48' is controlled by the actuator 68. In some embodiments, the housing 46' can have an opening that allows the housing 46' to be slidably disposed on a beam similar to the arm housings 46 in FIG. 2.

The grab arm 48' is sized so that in the gripping position it extends around at least half of the pipe circumference. In one embodiment, the grab arm 48' is sized so that it extends around between about one-half to about three-quarters of the pipe circumference. With this construction, the pipe 12 can be securely held between the arm 48' and the grab arm housing 46', and yet may be retracted in the manner discussed above for the grab arms 48 to allow the grab arm 48' to be moved out of the way when picking up or lowering the pipe 12 using the vacuum mechanism 70.

FIG. 9 illustrates another embodiment that uses a single grab arm 48'. In this embodiment, the grab arm 48' is pivotally mounted to the grab arm housing 46 or 46', the main beam 30, or to the vacuum mechanism. A vacuum seal mechanism 90 is provided on the vacuum mechanism in known manner to create a vacuum seal with the outer surface of the pipe 12. A rotation motor 92 is provided for rotating the grab arm housing, main beam, and vacuum mechanism about a vertical axis. In addition, an upper bracket 94 is mounted to a suitable structure, such as an excavator arm, by a pivot pin 96 that permits the attachment to pivot about the axis of the pivot pin 96. A lower bracket 98 is provided between the motor 92 and the upper bracket 94 and is connected to the upper bracket by a pivot pin 99 that is orthogonal to the pivot pin 96 to permit the lower bracket 98 and the rest of the attachment to pivot about the axis of the pivot pin 99.

Road Barrier Handling Attachment

FIGS. 10 and 11 illustrate an example of an attachment 150 that is configured for handling a road barrier 152. The attachment 150 includes a vacuum mechanism in the form of opposing vacuum pads 154 configured to clamp onto opposite sides of the road barrier 152 and apply a vacuum to each side of the road barrier. The vacuum pads 154 can have any form and construction suitable for clamping onto opposite sides of the road barrier 152 and applying vacuum for lifting the road barrier 152. U.S. Published Application No. 2014/0054911, which is incorporated herein by reference in its entirety, discloses suitable examples of the construction and operation of vacuum pads that can be used.

The attachment 150 can also include one or more grab arm assemblies 156, 158 that function similarly to the grab arm assemblies 42, 44, namely supplementing the holding force provided by the vacuum pads 154. As described in U.S. Published Application No. 2014/0054911, in the event of a failure in the vacuum mechanism, the vacuum pads 154 may lose their holding force and could drop the road barrier unless the road barrier is lowered to the ground right away. However, the grab arm assemblies 156, 158 also hold the road barrier 152 and continue to safely hold the road barrier 152 if a failure in the vacuum mechanism occurs. So the lifting operation of the road barrier can continue without having to lower the road barrier to the ground in an emergency manner.

FIG. 11 illustrates details of one of the grab arm assemblies 156, 158. In one embodiment, the grab arm assemblies 156, 158 are identical in construction and operation to each other. In another embodiment, the grab arm assemblies 156, 158 can be different in construction and/or operation from one another.

In FIG. 11, the grab arm assembly 156, 158 is illustrated as including an arm housing 160 having an opening 162 extending therethrough to permit the arm housing 160 to be slidably disposed on a main beam 164 (FIG. 10) of the attachment 150. Grab arms 166, 168 are pivotally attached to the arm housing 160 that are actuatable by one or more actuators 170 between an open position shown in FIG. 11 to a clamping position shown in FIG. 10. The actuator(s) 170 is connected between the grab arms 166, 168 and the arm housing 160.

In one embodiment, each grab arm assembly 156, 158 can be individually adjustable relative to the main beam 164 along the length of the main beam in a z-axis direction similar to the grab arm assemblies 42, 44 discussed above. The grab arm assemblies 156, 158 can be shifted in a manner described in U.S. Pat. No. 8,567,836.

In addition, each grab arm assembly 156, 158 includes a sensing mechanism 176 associated therewith that is configured to sense when the grab arm assembly is engaged with the road barrier 152 and ready for the grab arms 166 to be closed to clamp the road barrier. Any form of sensing mechanism 176 can be used. In the illustrated example, the sensing mechanism 176 includes a vertically adjustable (i.e. in the x-axis direction) plate 178 that is positioned to engage a top surface of the road barrier 152 when the attachment 150 is brought down into position to begin lifting the road barrier. A shaft 180 extends upwardly from the plate 178 that is slidably disposed within a housing 182 attached to the side of the arm housing 160. Indexing holes 184 provided in the shaft 180 and the housing 182 permit vertical adjustment of the position of the plate 178.

A sensor 186 mounted on the plate 178 senses engagement of the plate 178 with the road barrier 152. Once engagement is sensed, the grab arms 166 can then be actuated closed to clamp the road barrier 152 and initiate lifting.

The plate 178 can be adjusted up and down to accommodate different sizes of road barriers. In addition, the plate 178 can vary based on the shape of the upper end of the road barrier. The sensing mechanism 176 can also be removed completely if its function is not desired.

The attachment 150 can also include a head assembly 192 and a mount bracket (or upper head assembly) 193 to permit the head assembly 192 to rotate or swivel continuously relative to the mount bracket 193 about a vertical x-axis (i.e. continuous rotation about the vertical x-axis). The mount bracket 193 detachably and pivotally mounts the attachment 150 to the arm 20 of the construction equipment. One or more tilt actuators 194 (only one actuator 194 is visible in FIG. 10) extend between the head assembly 192 and the main beam 164 to selectively tilt the main beam 164 about a pivot 196 (i.e. about the y-axis).

To grip the road barrier 152, the ends of the grab arms 166, 168 can be provided with any clamping member(s) that can engage the opposite surfaces of the road barrier for lifting the road barrier. In the illustrated example, elongated clamping pads 188, 190 are pivotally mounted to the ends of the grabs arms 166, 168. The interior surface (i.e. road barrier facing surface) of each pad 188, 190 can be formed to enhance the gripping force on the road barrier. For example, the interior surface can be provided with a high friction material such as rubber and/or provided with friction enhancing configuration such as serrations.

In an embodiment, a single grab arm assembly 156, 158 can be used to grab the road barrier 152.

Slab Handling Attachment

FIG. 12 illustrates an example of an attachment 200 that is configured for handling a slab 202 such as a concrete slab, a steel plate, or the like. The attachment 200 includes a vacuum mechanism 204 that, in one embodiment, can be mounted to a main beam 206 of the attachment 200. The vacuum mechanism 204 is configured to seal with an upper surface 208 of the slab 202 and apply a vacuum for lifting the slab 202. An example of the construction and operation of a suitable vacuum mechanism that can be used is the Vacuworx Lifting System described at http://www.vacuworx.com/slab and available from VACULIFT™ Inc. of Tulsa, Okla.

The attachment 200 can also include one or more grab arm assemblies 210, 212 that function to supplement the holding force provided by the vacuum mechanism 204. In the event of a failure in the vacuum mechanism 204, or if the surface 208 is too contaminated or uneven to permit adequate sealing to create a vacuum, or if the vacuum mechanism 204 is not centered on the slab correctly, the vacuum mechanism may lose its holding force and could drop the slab unless the slab is lowered to the ground right away. However, the grab arm assemblies 210, 212 also hold the slab 202 and continue to safely hold the slab 202 if a failure in the vacuum mechanism occurs. So the lifting operation of the slab can continue without having to lower the slab to the ground in an emergency manner.

In one embodiment, the grab arm assemblies 210, 212 are identical in construction and operation to each other. In another embodiment, the grab arm assemblies 210, 212 can be different in construction and/or operation from one another.

In FIG. 12, each grab arm assembly 210, 212 is illustrated as including an arm housing 214 having an opening extending therethrough to permit the arm housing 214 to be slidably disposed on the main beam 206. Grab arms 216, 218 are attached to the arm housing 214 for gripping the slab 202. In one embodiment, the grab arm 218 is fixed, while the grab arm 216 is movable in a y-axis direction toward and away from the slab 202 between an open position and a closed, clamping position shown in FIG. 12 as indicated by the arrows. The grab arm 216 can be actuated by an actuator (not shown) disposed in the arm housing 214.

In one embodiment, a single grab arm assembly 210, 212 can be used to grab the slab 202.

In another embodiment, the grab arm assemblies 210, 212 can be arranged to grip the slab 202 from the ends of the slab 202 instead of from the sides as shown in FIG. 12.

The attachment 200 can also include a head assembly 220 and a mount bracket (or upper head assembly) 222 to permit the head assembly 220 to rotate or swivel continuously relative to the mount bracket 222 about a vertical x-axis (i.e. continuous rotation about the vertical x-axis). The mount bracket 222 detachably and pivotally mounts the attachment 200 to the arm 20 of the construction equipment. One or more tilt actuators 224, 226 extend between the head assembly 220 and the main beam 206 to selectively tilt the main beam 206 about a pivot 228 (i.e. about the y-axis)

Figure 4A:
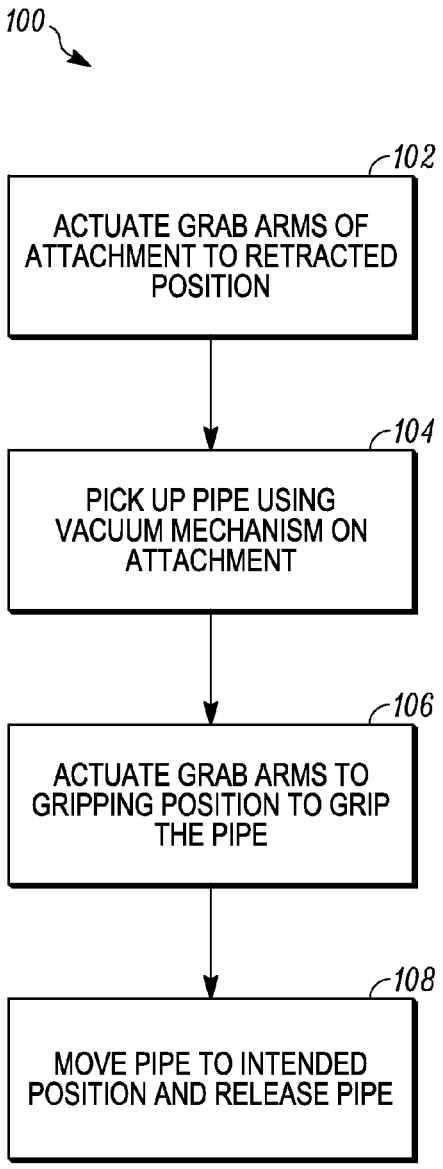
FIG. 4A illustrates an example method of using the attachment to lift a section of pipe.
Figure 4B:
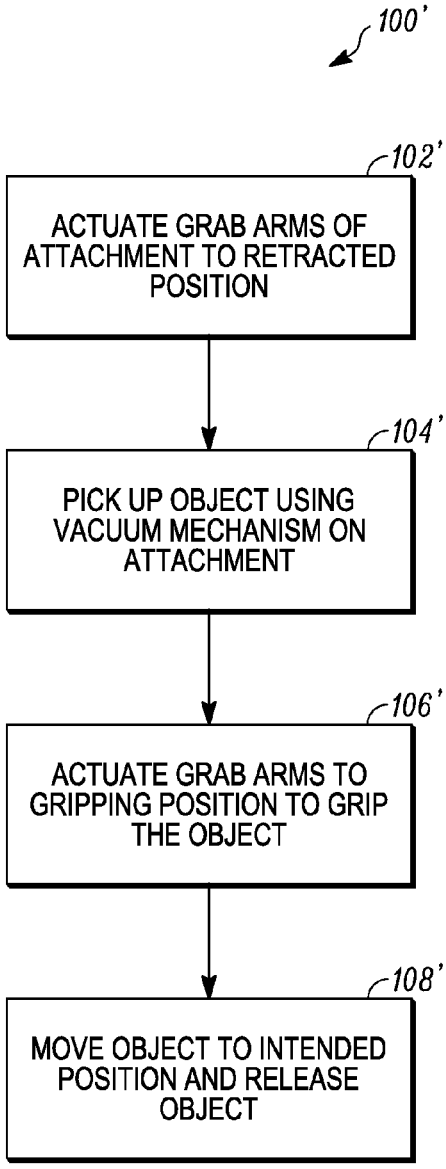
FIG. 4B illustrates an example method of using an attachment described herein to lift an object.

With reference to FIGS. 4A and 4B, an example method of using any one of the attachments described herein is illustrated. For sake of convenience, a method 100 in FIG. 4A will be described with respect to the attachment 10 being used to pick up a pipe from a stack of pipes with there being at least one pipe adjacent to the pipe to be picked up as shown in FIG. 3. However, the method 100 can also be used for placing a pipe onto a pipe stack. In addition, all of the attachments described herein can be used in a similar method 100' to pick up objects in general as illustrated in FIG. 4B.

With reference to FIG. 4A, in the method 100, in step 102 the grab arms 48 are first actuated to the retracted position as described above if the grab arms are not already at the retracted position. In one embodiment, this can be done as the construction equipment 14 brings the attachment 10 into position near the pipe stack, or before or after the attachment 10 is moved into position near the pipe stack.

Once the attachment is properly positioned, in step 104 the vacuum mechanism 70 is then used to pick up the pipe from the stack. This is achieved by bringing the attachment 10 down toward the pipe to be picked up until the vacuum mechanism 70 is engaged with the top surface of the pipe. The vacuum is then applied as in conventional vacuum pipe lifting mechanisms and the pipe is picked up by lifting the attachment 10 under the force of the construction equipment 14.

Once the pipe is lifted and the grab arms are clear of any adjacent pipes, in step 106 the grab arm(s) 48 are then actuated to the gripping position to grip the pipe. Therefore, in addition to the holding force provided by the vacuum mechanism 70, the grab arm(s) 48 also grip the pipe. If for some reason the holding force provided by the vacuum mechanism 70 fails, the pipe remains held by the grab arms. Alternatively, if the additional holding force provided by the grab arm(s) 48 is not desired, the grab arm(s) 48 are not used and the pipe is held solely by the vacuum mechanism 70.

In step 108, the pipe is then moved to its intended position under the force of the construction equipment 14. For example, the cab 24 can be rotated in a desired direction and/or the construction equipment 14 can move by rotating the tracks 22*a*, 22*b* and/or the arm 20 can extend or retract to move the pipe to the desired location. Once in position, the pipe is lowered into position and released by releasing the hold of the grab arm(s) 48 (if used) and terminating the vacuum of the vacuum mechanism 70 on the pipe.

If the pipe is placed into a trench or on the ground in step 108, the pipe can be released by moving the grab arms toward the retracted position a sufficient distance so that the pipe can clear the grab arms. The pipe is then fully lowered into position and the vacuum terminated, thereby freeing the pipe. The attachment 10 can then be moved to pick up another pipe. If the grab arms are not used to supplement the holding force of the vacuum mechanism, the grab arms may not need to be actuated toward the retracted position since the grab arms may already be at the a retracted position.

If the pipe is placed onto a stack of pipes in step 108 adjacent to one or more pipes already on the stack, the pipe can be released by moving the grab arm(s) to the fully retracted position to avoid interference between the grab arms and other pipes on the pipe stack. The pipe is then fully lowered into position onto the pipe stack and the vacuum terminated, thereby freeing the pipe. The attachment 10 can then be moved to pick up another pipe. If the grab arms are not used to supplement the holding force of the vacuum mechanism, the grab arms may not need to be actuated to the fully retracted position since they may already be at the fully retracted position.

With reference to FIG. 4B, a similar method 100' using any of the attachments described herein as applied to handling objects in general is illustrated. In the method 100', in step 102' the grab arm(s) are first actuated to the retracted position as described above if the grab arms are not already at the retracted position. Once the attachment is properly positioned, in step 104 the vacuum mechanism is then engaged with the object and vacuum applied to pick up the object. Once the object is lifted and the grab arm(s) are clear of any adjacent obstructions, in step 106' the grab arm(s) are then actuated to the gripping position to grip the object. Therefore, in addition to the holding force provided by the vacuum mechanism, the grab arm(s) also grip the object. If for some reason the holding force provided by the vacuum mechanism fails, the object remains held by the grab arm(s). Alternatively, if the additional holding force provided by the grab arm(s) is not desired, the grab arm(s) are not used and the object is held solely by the vacuum mechanism.

In step 108', the object is then moved to its intended position under the force of the construction equipment 14. For example, the cab 24 can be rotated in a desired direction and/or the construction equipment 14 can move by rotating the tracks 22*a*, 22*b* and/or the arm 20 can extend or retract to move the object to the desired location. Once in position, the object is lowered into its desired position and released by releasing the hold of the grab arm(s) (if used) and terminating the vacuum of the vacuum mechanism.

When lowering the object, the object can be released by moving the grab arm(s) toward the retracted position a sufficient distance so that the object can clear the grab arm(s). The object can then be fully lowered into position and the vacuum terminated, thereby freeing the object. The attachment can then be moved to pick up another object. If the grab arm(s) are not used to supplement the holding force of the vacuum mechanism, the grab arm(s) may not need to be actuated toward the retracted position since the grab arm(s) may already be at the a retracted position.

When an object is held by the attachments described herein, the various movement capabilities of the attachments, together with the movements of the arm 20 of the construction equipment 14, permit the object to be held by the attachment horizontally, vertically (not shown) with the main beam of the attachment oriented generally perpendicular to the ground, and any angle therebetween.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. An attachment that is attachable to construction equipment, comprising:

a vacuum mechanism configured to pick up an object via vacuum applied to a surface of the object by the vacuum mechanism; and first and second grab arm assemblies, each grab arm assembly including at least one grab arm that is pivotally mounted so as to be pivotable between a retracted position and a gripping position at which the at least one grab arm grips an object held by the vacuum mechanism;

the vacuum mechanism includes a first end that faces toward the first grab arm assembly and a second end that faces toward the second grab arm assembly, and the vacuum mechanism is disposed between the first and second grab arm assemblies with the first end spaced from the first grab arm assembly and the second end spaced from the second grab arm assembly;

wherein the vacuum mechanism and the first and second grab arm assemblies are rotatable together about a rotation axis that extends through the vacuum mechanism; and wherein the grab arm of each of the first and second grab arm assemblies includes a tip end, and at the retracted position the tip end is disposed above a highest level of an object to be picked up by the vacuum mechanism.

2. The attachment of claim 1, wherein the attachment is a pipe handling attachment, or a slab handling attachment.

3. An attachment that is attachable to construction equipment, comprising:

a mount bracket for detachably mounting the attachment to construction equipment;

a head assembly rotatably connected to the mount bracket so that the head assembly is rotatable relative to the mount bracket about a rotation axis;

a support structure connected to the head assembly and rotatable therewith about the rotation axis;

a vacuum mechanism configured to pick up an object via vacuum applied to a surface of the object by the vacuum mechanism, the vacuum mechanism is mounted to the support structure and the vacuum mechanism is rotatable with the support structure about the rotation axis;

first and second grab arm assemblies mounted to the support structure and rotatable therewith about the rotation axis, each grab arm assembly including at least one grab arm that is pivotally mounted so as to be pivotable between a retracted position and a gripping position at which the at least one grab arm grips an object held by the vacuum mechanism;

the vacuum mechanism includes a first end that faces toward the first grab arm assembly and a second end that faces toward the second grab arm assembly, and the vacuum mechanism is disposed between the first and second grab arm assemblies with the first end spaced from the first grab arm assembly and the second end spaced from the second grab arm assembly;

the rotation axis extends through the vacuum mechanism; and wherein the grab arm of each of the first and second grab arm assemblies includes a tip end, and at the retracted position the tip end is disposed above a highest level of an object to be picked up by the vacuum mechanism.

4. The attachment of claim 3, wherein the support structure is pivotally connected to the head assembly whereby the support structure together with the vacuum mechanism and the first and second grab arm assemblies can pivot relative to the head assembly about an axis that is generally perpendicular to a longitudinal axis of the vacuum mechanism.

5. The attachment of claim 4, wherein the rotation axis is generally perpendicular to the longitudinal axis of the vacuum mechanism.

6. The attachment of claim 3, wherein the rotation axis is generally perpendicular to a longitudinal axis of the vacuum mechanism.

7. The attachment of claim 3, wherein the attachment is a pipe handling attachment, or a slab handling attachment.

8. An attachment that is attachable to construction equipment, comprising:

a mount bracket for detachably mounting the attachment to construction equipment;

a head assembly rotatably connected to the mount bracket so that the head assembly is rotatable relative to the mount bracket about a rotation axis;

a support structure connected to the head assembly and rotatable therewith about the rotation axis;

a primary lifting mechanism configured to pick up an object without using grab arms, the primary lifting mechanism is mounted on the support structure at a location such that the rotation axis extends through the primary lifting mechanism, and the primary lifting mechanism is rotatable with the support structure about the rotation axis;

first and second grab arm assemblies mounted to the support structure and rotatable therewith about the rotation axis, each grab arm assembly including at least one grab arm that is pivotally mounted so as to be pivotable between a retracted position and a gripping position at which the at least one grab arm grips an object held by the primary lifting mechanism;

the primary lifting mechanism includes a first end that faces toward the first grab arm assembly and a second end that faces toward the second grab arm assembly, and the primary lifting mechanism is disposed between the first and second grab arm assemblies with the first end spaced from the first grab arm assembly and the second end spaced from the second grab arm assembly.

9. The attachment of claim 8, wherein the primary lifting mechanism comprises a vacuum mechanism.

10. A road barrier handling attachment that is attachable to construction equipment, comprising:

a vacuum mechanism that is configured to pick up a road barrier via vacuum applied to opposing surfaces of the road barrier by the vacuum mechanism, the vacuum mechanism includes opposing vacuum pads with vacuum applying faces that face one another;

first and second grab arm assemblies, each of the first and second grab arm assemblies including a pair of grab arms with opposing clamping members that face one another, the grab arms and the clamping members are moveable between a retracted position and a gripping position at which the clamping members can grip the opposing surfaces of the road barrier held by the vacuum pads, and the clamping members face in the same directions as the vacuum pads when the clamping members and the vacuum pads are engaged with the opposing surfaces of the road barrier; and each of the vacuum pads includes a first end that faces toward the first grab arm assembly and a second end that faces toward the second grab arm assembly, and the vacuum pads are disposed between the first and second grab arm assemblies with the first ends spaced from the first grab arm assembly and the second ends spaced from the second grab arm assembly.

* * * * *